United States Patent [19]

Radek

[11] 4,298,139

[45] Nov. 3, 1981

[54] CUP DISPENSER

[75] Inventor: John R. Radek, Hinsdale, Ill.

[73] Assignee: Ready Metal Manufacturing Company, Chicago, Ill.

[21] Appl. No.: 61,709

[22] Filed: Jul. 30, 1979

[51] Int. Cl.[3] ..... B65H 1/02

[52] U.S. Cl. ..... 221/198; 312/61

[58] Field of Search ..... 221/45, 46, 56–60, 221/198; 53/384; 312/61

[56] References Cited

U.S. PATENT DOCUMENTS

| | | | |
|---|---|---|---|
| 1,597,451 | 8/1926 | Loewenbach | 221/59 X |
| 1,677,166 | 7/1928 | Baur | 221/59 |
| 1,993,885 | 3/1935 | Horwitt | 221/46 X |
| 2,021,659 | 11/1935 | Judkins | 221/198 X |
| 2,034,516 | 3/1936 | Hunt et al. | 221/198 X |
| 2,277,815 | 3/1942 | Broeden et al. | 221/59 X |
| 3,247,647 | 4/1966 | Koch | 53/384 |
| 4,005,801 | 2/1977 | Musser | 221/56 |

*Primary Examiner*—F. J. Bartuska

*Attorney, Agent, or Firm*—Frank H. Marks

[57] ABSTRACT

A dispenser for disposable cups for food or beverages, designed especially for use in "fast food" establishments where wastage is a problem. Cups formed of inexpensive material, such as cardboard, are disposed, collapsed to flat generally planar condition, in a stack, within a tray or drawer slidably arranged in a housing. The structure is constructed so that digital access is restricted to one or two cups at a time, a follower functioning to maintain the cups in accessible position until the supply is exhausted. Also, provision is made for facilitating the opening of a collapsed cup upon its withdrawal.

1 Claim, 4 Drawing Figures

CUP DISPENSER

My invention relates to dispensers for flat objects arranged in a stack, such as collapsed cardboard cups intended for individual withdrawal.

More particularly, my invention has to do with dispensers for stacked, collapsed containers of disposable material such as cardboard or the like. Such dispensers may, in one application, be used in a "fast food" establishment.

In such places, during rush hours, employees must work quickly to meet customer demands for sandwiches, beverages, "french fries," etc. A major problem is the offering of food products to the customer in sanitary condition without human handling, with minimum expenditure of time and movement.

Another problem is wastage, where profit margins are small. Accordingly, dispensers should offer an article singly, in such manner as to insure against waste or vandalism.

To meet such requirements I have devised a device that will house and dispense a plurality of disposable food or beverage containers, arranged in stacked, collapsed condition and presented for convenient grasping and withdrawal one at a time, substantially insuring against mass withdrawal.

BACKGROUND

Dispensers for disposable cups are known, usually cylindrical, with limited capacity.

Paper cups in flat, collapsed condition are also old in the art, with dispensers for same. A common shortcoming in such dispensers is that they permit wastage of the containers.

BRIEF OUTLINE OF INVENTION

My invention contemplates a dispenser of the character above referred to, comprising a boxlike housing for a tray designed to support a stack of collapsed disposable containers. Means is provided whereby only a single collapsed container, or a very restricted number, is presented for convenient manual withdrawal from the stack.

Arranged in combination with the tray is a spring biased follower whereby the stacked cups are constantly urged forwardly for convenient access to withdrawal.

Releasable means is provided at the open front of the housing for retaining the tray within the housing until its withdrawal is desired for reloading.

As part of the combination I also provide means for facilitating opening of a collapsed cup upon its withdrawal from the dispenser.

Various other objects and advantages will no doubt suggest themselves to those skilled in the art as the description proceeds.

BRIEF DESCRIPTION OF THE DRAWINGS

Referring now to the drawings forming part of this specification and illustrating a preferred embodiment of my invention.

DETAILED DESCRIPTION

Figure 1:
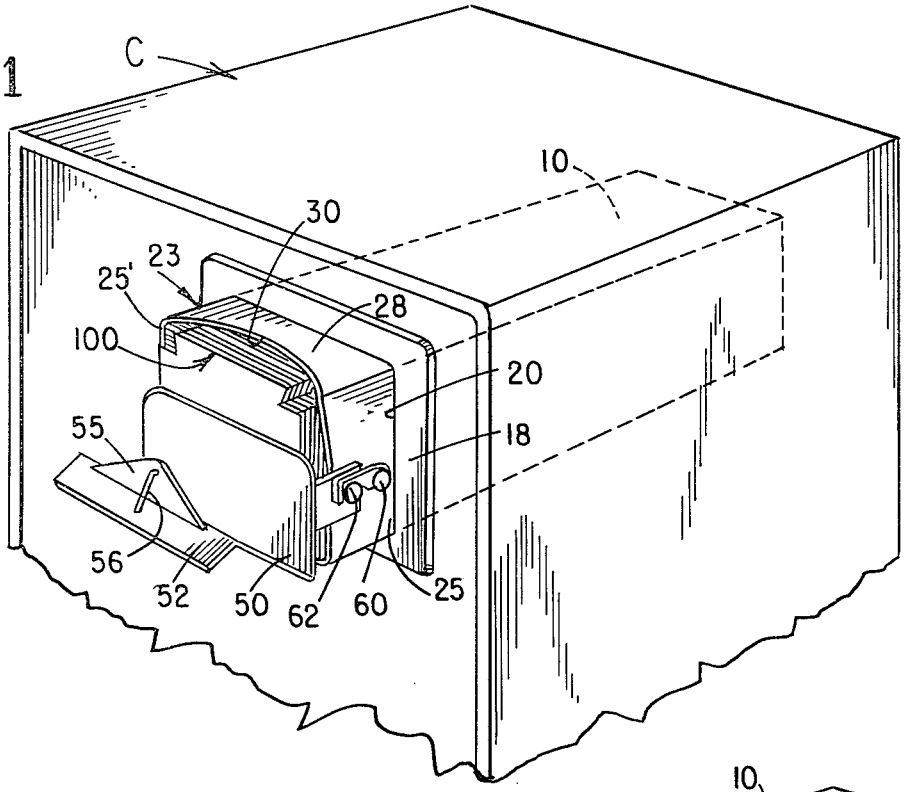
FIG. 1 is a perspective view of a cup dispenser embodying my invention in normal condition of use, shown mounted in a cabinet.

A cup dispenser embodying my invention comprises a housing or receptacle 10, which may conveniently be in the form of a rectangular parallelopiped having four side walls 12, 12, and a front end with a rectangular flange or collar 18 defining a rectangular opening 20.

Housing 10 extends forwardly beyond collar 18 to form a forward portion 23 having a bottom wall 24, a pair of opposed side walls 25, 25' and a top wall 28. The latter has a concave recess 30 for a purpose that will hereinafter appear.

Slidably disposed within housing 10 is a tray T having a bottom wall 32, a back wall 35 and relatively short parallel side walls 37, 37. Rear wall 35 retains a helical compression spring 45 engaging a cup-shaped follower member 40, a flexible member 42, such a chain, being secured to said follower and the wall 35. The chain is of such length as to permit the follower to urge forwardly a stack of collapsed cups 100 until the supply thereof is exhausted.

At the front end of tray T is a vertical closure plate 50 normally spaced forwardly a slight distance from the front edge of the housing, when the tray is fully retracted, as in FIG. 1, to permit convenient digital access to the forwardmost cup in the stack disposed in the tray.

Projecting forwardly from plate 50 is a base plate 52, which extends angularly upwardly and forwardly from plate 50. Extending upwardly from plate 52 is another plate 55 and extending obliquely downwardly from and in a plane normal to the latter is a pair of spreader members, such as wires, 56, 56.

Figure 4:
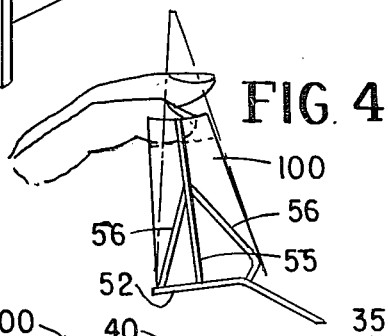
FIG. 4 is an elevational view showing the cup opening means in use.
Figure 3:
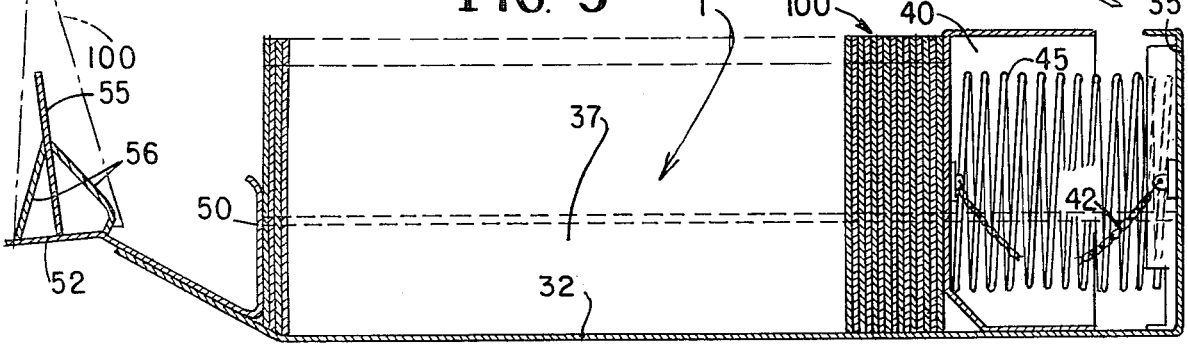
FIG. 3 is a sectional view taken substantially along line 3—3 of FIG. 2.

As seen in FIGS. 3 and 4, a cup 100, after withdrawal from the front of the stack, may be opened by digitally pressing it downwardly over spreader members 56.

A latch member 60 is pivotally attached to a side plate 25 of housing 10 for retaining tray T in closed position (FIG. 1), a boss 62 being provided on the tray for engagement with said latch 60.

A cup dispenser as described above may, if desired, be mounted within a cabinet C, as seen in FIG. 1, or may be supported on a counter or otherwise.

Figure 2:
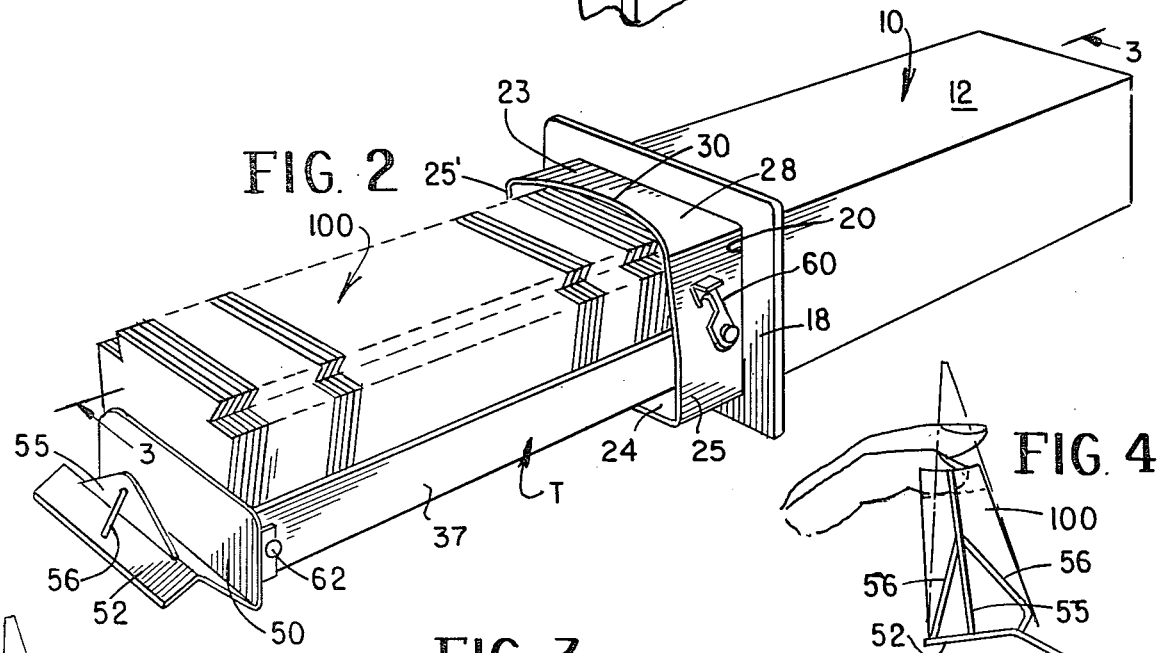
FIG. 2 is a similar view, with the cup supporting tray extended as for loading.

For loading, the tray is normally extended forwardly from housing 10 to a position as seen in FIG. 2. Cups of any appropriate design, in collapsed, more or less planar condition, are then inserted in the tray and the loaded tray then slid back into the housing to assume a position as in FIG. 1, and secured by latch 60. Loading may be facilitated by fully withdrawing tray. Loading may be facilitated by fully withdrawing the tray.

It will be seen that, when in condition for use, only a single cup may conveniently be withdrawn from the tray by a person having the fingers of an average adult. The concave arcuate formation of plate 28 and spacing of plate 50 from the front edge of the housing permit only limited digital access to cups 100. Thus, it is practically impossible for a person to grasp more than a single cup.

After extraction from the stack in the tray, a cup may be opened conveniently by sliding it over plate 55 and oblique spreaders 56, the latter serving to spread apart the opposed sides of the collapsed cup. The bottom wall of the cup, (shown in the drawings in reverse or upside down position), is then digitally pressed down (FIG. 4).

If desired, the parts shown at the front end of tray T (parts 50, 52, 55, 56) might be hingedly attached to base 32 of tray T, to facilitate loading of the tray, such a hinge being an obvious mechanical expedient.

CONCLUSION

It will be seen that I have provided a greatly improved construction of cup dispenser that substantially expedites the operation of a fast food facility with relation to the dispensing of food containers. The construction is simple and inexpensive, with a minimum of parts, and is highly sanitary.

Various changes may occur to those skilled in the art without departing from the spirit of my invention. Hence, I do not wish to be limited to the specific form shown and described or uses mentioned except to the extent indicated by the appended claims.

I claim:

1. A dispenser for disposable cups in collapsed stacked condition, comprising a. a sleevelike housing having side walls and an open front portion, b. a relatively shallow tray member slidable through said front portion and having a bottom portion for supporting a stack of flattened disposable cups, side walls, and a front cup-retaining portion attached to and carried by the tray member and protruding beyond said open front portion in the retracted position of said tray member, c. a follower for resiliently urging cups forwardly in the tray, d. latching means on the outside of said housing and tray member for detachably securing the tray in the housing, and e. means comprising an arcuate concave recess at the front of the upper wall of said housing, whereby a limited number of cups is exposed for digital extraction from the tray.

* * * * *